United States Patent [19]

Lin

[11] Patent Number: 4,975,815

[45] Date of Patent: Dec. 4, 1990

[54] STRUCTURE OF DESK LAMP

[76] Inventor: Jack Lin, 4F, No. 112, Wen Lin North Rd., Taipei, Taiwan

[21] Appl. No.: 507,533

[22] Filed: Apr. 11, 1990

[51] Int. Cl.[5] ..... F21V 21/26

[52] U.S. Cl. ..... 362/269; 362/275; 362/427; 362/287; 362/419

[58] Field of Search ..... 362/269, 275, 287, 427, 362/419

[56] References Cited

U.S. PATENT DOCUMENTS 2,608,367 8/1952 Boltuch ..... 362/427

2,850,622 9/1958 Johnson ..... 362/275

*Primary Examiner*—Carroll B. Dority

*Attorney, Agent, or Firm*—Lowe, Price, LeBlanc, Becker & Shur

[57] ABSTRACT

A desk lamp, which comprises a lamp holder having an unitary sleeve for the insertion therein of a first piece of wedge block to secure a journal therein by means of a doweled joint; a rod support having one end fastened in the journal and an opposite end fastened in a connector which is coupled with a second piece of wedge block through a doweled joint and fastened in a vertical sleeve of a lamp stand; and a control knob secured to the connector through a sleeve joint to control the positioning of the rod support on the lamp stand.

1 Claim, 4 Drawing Sheets

STRUCTURE OF DESK LAMP

BACKGROUND OF THE INVENTION

The present invention is related to desk lamps and more particularly to a desk lamp with improved fastening structure for easy assembly.

Regular desk lamps are generally comprised of a lamp stand having mounted thereon a support to hold a lamp holder, in which the parts of a lamp assembly are generally connected with one another by means of fastening elements. This conventional mounting procedure in assembling a desk lamp is time consuming and difficult to fix.

SUMMARY OF THE INVENTION

The present invention has been accomplished with such circumstances in view. It is an object of the present invention to provide a desk lamp which is simple in arrangement, rapid in assembly and convenient in projection control.

A desk lamp according to the present invention is generally comprised of a lamp holder having an unitary sleeve for the insertion therein of a first piece of wedge block to secure a journal therein by means of doweled joint; a rod support having one end fastened in the journal and an opposite end fastened in a connector which is coupled with a second piece of wedge block through doweled joint and fastened in a vertical sleeve of a lamp stand; and a control knob secured to the connector through sleeve joint to control the positioning of the rod support on the lamp stand.

BRIEF DESCRIPTION OF THE DRAWINGS

Embodiment of the present invention will now be described by way of example with reference to the annexed drawings, in which.

Figure 1:
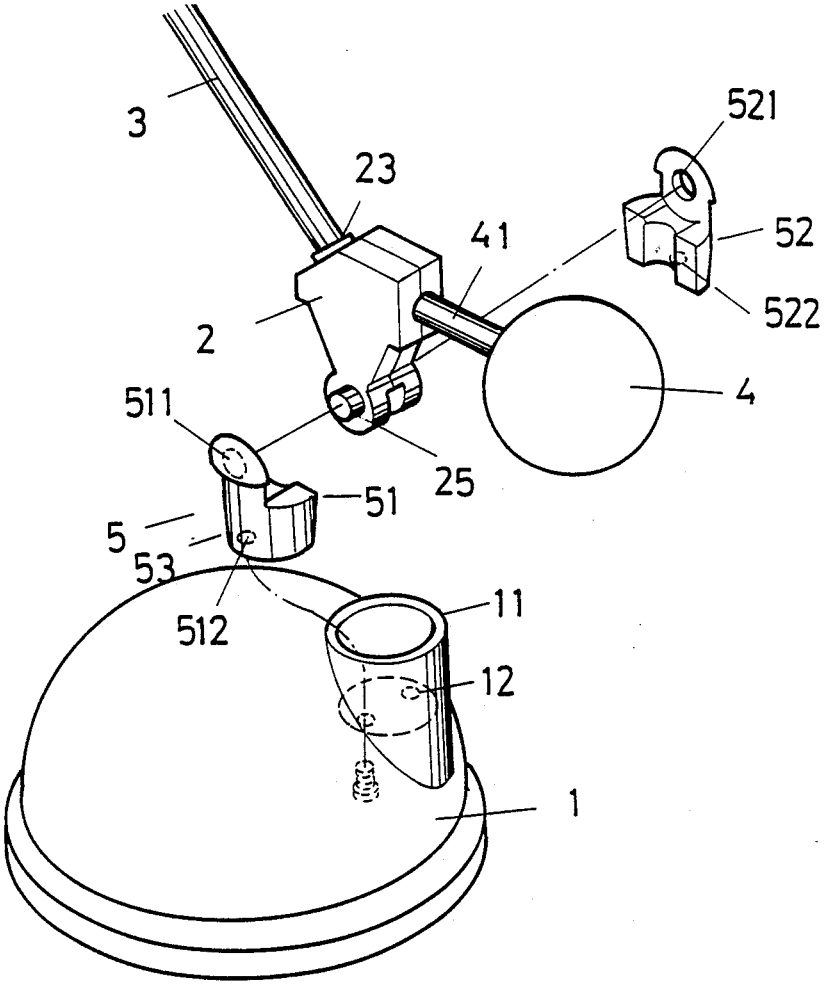
FIG. 1 is a partly perspective fragmentary view of the present invention, illustrating the connecting structure between the lamp stand and the rod support.
Figure 2:
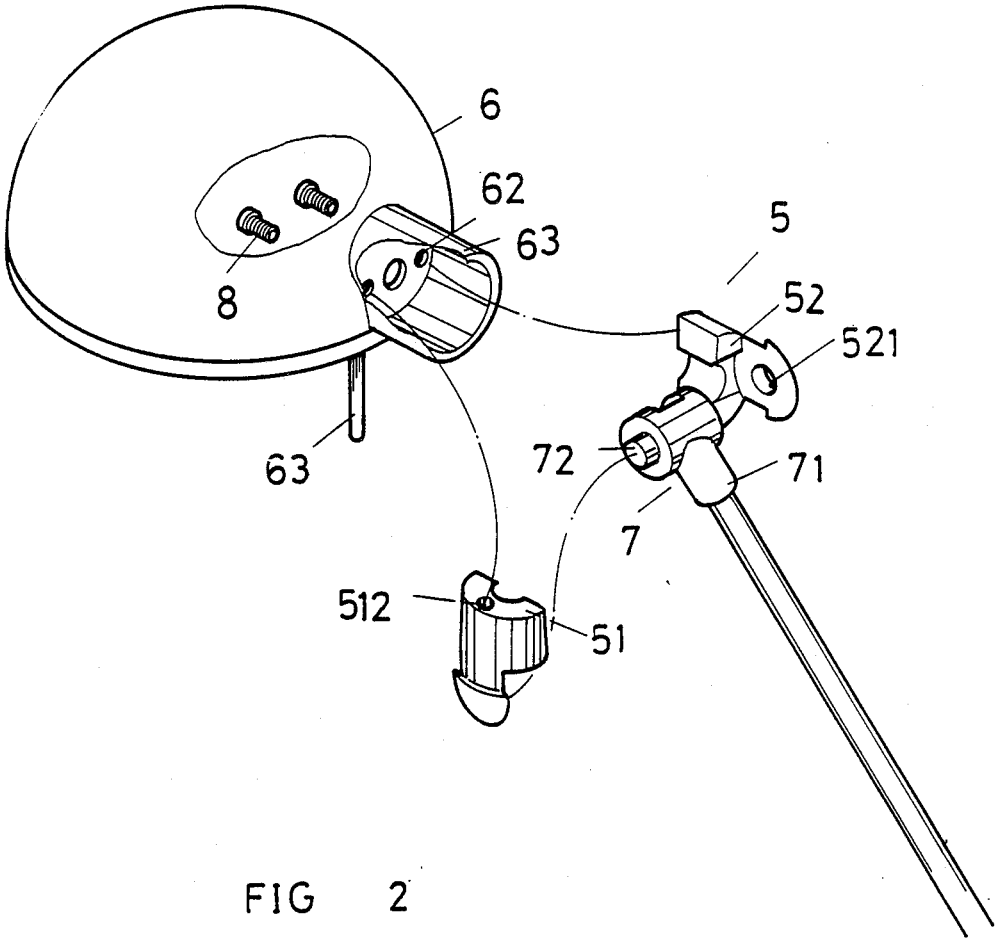
FIG. 2 is a partly perspective fragmentary view of the present invention, illustrating a connecting structure between the lamp holder and the rod support.
Figure 3:
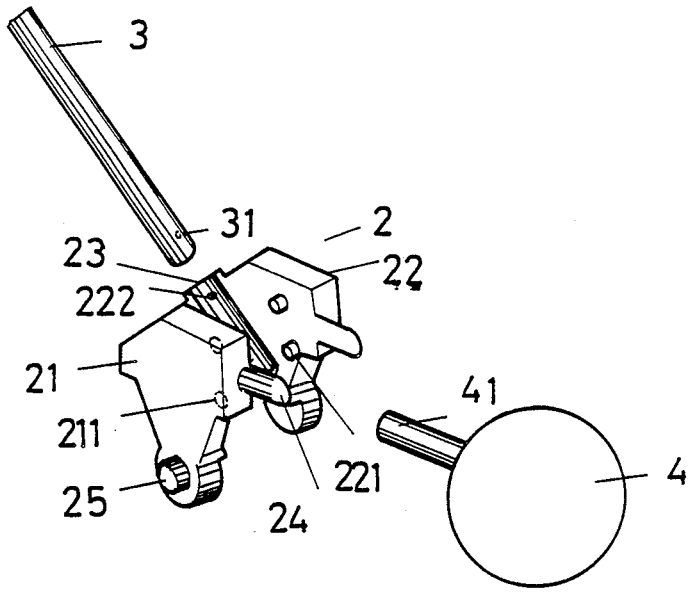
FIG. 3 is a partly perspective fragmentary view of the present invention, illustrating a connecting structure between the connector, the rod support and the control knob.
Figure 4:
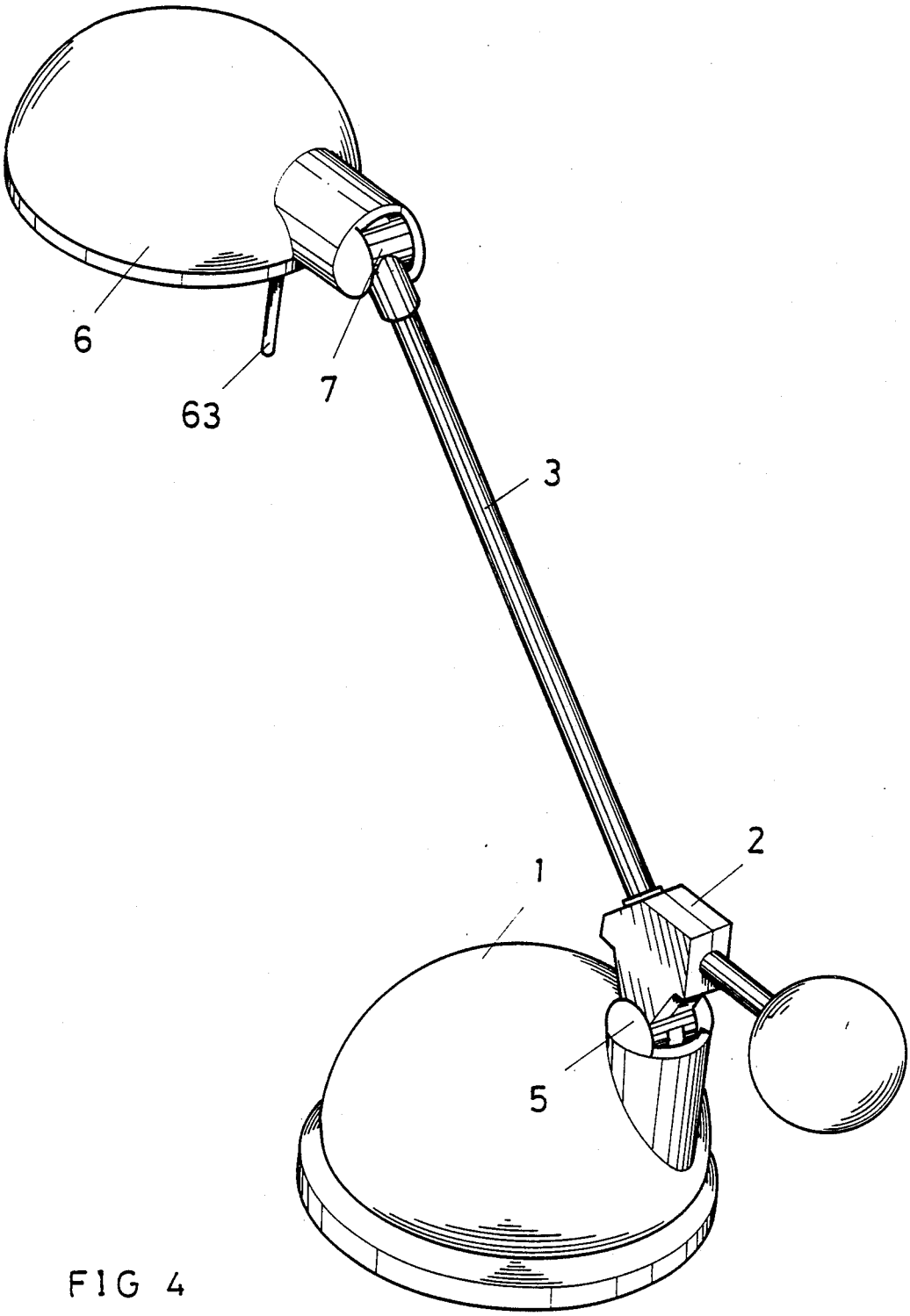
FIG. 4 is a perspective view of the present invention.

DETAILED DESCRIPTION OF THE PREFERRED EMBODIMENT:

Referring to the annexed drawings in greater detail, a desk lamp in accordance with the present invention is generally comprised of a lamp stand 1, a connector 2, a rod support 3, a spherical control knob 4, two wedge blocks 5, a lamp holder 6, a journal 7 and a plurality of screws 8.

The lamp stand 1 comprises a vertical sleeve portion 11 upstanding therefrom at one side and having therein two fastening holes 12.

The connector 2 is comprised of two opposite plates 21, 22, in which a first plate 21 comprises a plurality of recessed holes 211 corresponding to a plurality of inner dowels 222 on a second plate 22 so that both two opposite plates 21, 22 are connected together through doweled joint. After the two opposite plates 21, 22 are connected together, a round hole 23 is defined therein at one end and a rod-like projecting portion 24 is formed to project therefrom at an opposite end. The two opposite plates 21, 22 also comprise two external side dowels 25 bilaterally extending outward.

The rod support 3 has a pivot hole 31 penetrating through its lower end. During assembly, the lower end of the rod support 3 is inserted in the round hole 23 of the connector 2 permitting the projecting pin 222, which extends from inner wall surface of the second plate 22, to insert in the pivot hole 31 so as to secure the rod support 3 in the connector 3.

The spherical control knob 4 comprises an unitary sleeve 41 sleeved on the rod-like projection portion 24 of the connector 2 for positioning.

A wedge block 5 of the present invention is formed of two opposite, substantially arch-shaped elements 51,52 having each a recessed hole 511 or 521 laterally on its top and a bolt hole 512 or 522 on its bottom. The periphery of the wedge block 5 is slightly in conical shape convenient for insertion in the vertical sleeve portion 11 of the lamp stand 1. During assembly, the two arch-shaped elements 51, 52 are bilaterally attached to the connector 2 permitting the two side dowels 25 of the connector 2 to respectively inserted in the two recessed holes 511, 521 thereof. After having been attached to the connector 2, the wedge block 5 is inserted in the vertical sleeve portion 11 of the lamp stand 1 such that two screw can be respectively fastened through the fastening holes 12 of the lamp stand 1 in the bolt holes 512, 522 of the wedge block 5 to fixedly secure the wedge block 5 and the connector 2 in the vertical sleeve portion 11 of the lamp stand 1.

The lamp holder 6 comprises an unitary pull rod 63 extending downward therefrom, a side sleeve portion 61 horizontally projecting outward and having therein a fastening hole 62.

The journal 7 comprises an unitary sleeve portion 71 at one end for the fastening therein of the rod support 3, two opposite, unitary side dowels 72 at both lateral sides. Similar to the mounting procedure of the connector in the sleeve portion 11 of the lamp stand, the journal 7 is secured in the sleeve portion 61 of the lamp holder 6 by means of another wedge block 5 and two screws 8.

As described above, the connection of the lamp holder 6 with the journal 7 and the connector 2 with the lamp stand 1 are respectively made through a wedge block 5 each by means of the engagement of dowels 72, 25 in recessed holes 511, 521. Therefore, through the control of the 11 spherical control knob 4 or the pull rod 63, the positioning of the rod support 3 and the lamp holder 6 can be conveniently adjusted.

The connection of the wedge block 5 with the connector 2, or the connection of the rod support 3 with the connector 2, the control knob 4 or the wedge block 5 are respectively made through sleeve joint such that mounting procedure of the assembly becomes easy.

What is claimed is:

1. A desk lamp, comprising a lamp stand for the connection thereto of a rod support by means of a first piece of wedge block and a connector to hold a lamp holder through a journal and a second piece of wedge block, and a control knob connected to said connector to control the positioning of said rod support;

said lamp stand having a vertical sleeve portion upstanding therefrom at one side, said vertical sleeve having two fastening holes therein;

said connector being comprised of a first plate member having a plurality of recessed holes on its inner side and a second plate having a projecting pin and a plurality of inner dowels on its inner side, the inner dowels of said second plate member being respectively inserted in the recessed holes of said first plate member, said first and second plate members being connected together to define a round hole at one end, a rod-like projecting portion at an opposite end and two side dowels at both lateral sides;

said rod support having a pivot hole penetrating through its lower end and being secured in the round hole of said connector by the projecting pin of said second plate member of said connector which inserts in said pivot hole;

said control knob comprising a unitary sleeve sleeved on the rod-like projection portion of said connector for positioning;

said first and second wedge blocks being each comprised of two opposite, substantially arch-shaped elements having each a recessed hole laterally on its top and a bolt hole on its bottom, said wedge blocks having each a conical periphery, said fist wedge block being fastened in the vertical sleeve portion of said lamp stand to secure said connector therein;

said lamp holder comprising an unitary pull rod extending downward therefrom and a side sleeve portion horizontally projecting outward, said side sleeve portion having therein a fastening hole; and said journal comprising an unitary sleeve portion at one end for the fastening therein of said rod support and two opposite, unitary side dowels at both lateral sides respectively inserted in holes of a second wedge block which is inserted in the sleeve portion of said lamp holder and fixedly fastened therein by screws;

wherein the positioning of said rod support on said lamp stand and the positioning of said lamp holder on said rod support are respectively controlled by means of said spherical control knob and the pull rod of said lamp holder.

* * * * *